US005545952A

United States Patent [19]

Mortensen

[11] Patent Number: 5,545,952

[45] Date of Patent: Aug. 13, 1996

[54] SELF GROUNDING LAMP FOR SPECIAL USE IN AN UNDERWATER ENVIRONMENT

[75] Inventor: Dana Mortensen, Sanford, N.C.

[73] Assignee: Essef Corporation, Chardon, Ohio

[21] Appl. No.: 357,780

[22] Filed: Dec. 16, 1994

Related U.S. Application Data

[63] Continuation of Ser. No. 119,617, Sep. 13, 1993, abandoned.

[51] Int. Cl.[6] ..... H01J 7/44

[52] U.S. Cl. ..... 315/74; 315/73; 315/125

[58] Field of Search ..... 315/73, 74, 75, 315/119, 125

[56] References Cited

U.S. PATENT DOCUMENTS

| | | | |
|---|---|---|---|
| 462,339 | 11/1891 | Thomson | 315/73 |
| 466,400 | 1/1892 | Edison et al. . | |
| 476,530 | 6/1892 | Edison . | |
| 2,007,412 | 4/1934 | Straty et al. | 315/73 |
| 2,076,527 | 12/1935 | Corvington et al. | 315/73 |
| 3,382,403 | 5/1968 | Lloyd | 315/73 |
| 3,794,880 | 2/1974 | Peretti et al. . | |
| 4,032,816 | 6/1977 | Rokosz . | |
| 4,216,411 | 8/1980 | Ehret et al. | 315/119 |
| 4,752,718 | 6/1988 | Strauss et al. . | |
| 4,973,881 | 11/1990 | Haraden et al. | 315/119 |

*Primary Examiner*—Robert Pascal
*Assistant Examiner*—Darius Gambino
*Attorney, Agent, or Firm*—Pearne, Gordon, McCoy & Granger

[57] ABSTRACT

An incandescent bulb for use in a submerged swimming pool light fixture is disclosed, which includes a filament, at least one spring-biased filament support, and a grounding device. The filament support includes an exposed current-conducting portion and is moveable in response to the spring bias. The current-conducting portion of the filament support is arranged to allow it to come into electrical contact with the grounding device when the filament support moves in response to the bias of the spring. The filament is disposed to prevent movement of the filament support when the filament is intact and the lamp is in normal operating condition. When the filament is broken or is otherwise caused to release the filament support arms, the arms are free to move in response to the spring bias, causing the current-conducting portion of the arm to contact the grounding device, thereby providing a direct connection to ground for the incoming electrical current, and preventing escape of the current into the adjacent pool water.

19 Claims, 3 Drawing Sheets

SELF GROUNDING LAMP FOR SPECIAL USE IN AN UNDERWATER ENVIRONMENT

This is a continuation of application Ser. No. 08/119,617, filed Sep. 13, 1993, now abandoned.

FIELD OF THE INVENTION

The present invention relates to electrical current-diversion and grounding safety devices for use in underwater light fixtures, in which a hazard of electrical shock exists in cases of accidental breakage of the fixture, particularly in a swimming pool light fixture.

BACKGROUND OF THE INVENTION

Devices such as cut-outs and switching devices have been used in conjunction with incandescent and other light bulbs for many years. Some of these systems have been for the purpose of maintaining an electrical connection through a failed light bulb, in order to maintain electrical current to other series-connected bulbs in a grid. U.S. Pat. No. 466,400 discloses a spring loaded mechanism to re-connect the conductors in an incandescent bulb when the filament has been broken, for this purpose.

U.S. Pat. No. 476,530 discloses a switch for the same purpose, in which plates separated by a small distance are charged by the current-carrying elements to which they are attached. When the filament breaks, the charge between these plates is increased such that the plates are sufficiently attracted to each other that they come into contact, thereby restoring current to the remaining series-connected grid.

U.S. Pat. No. 3,794,880 discloses a bulb having a wire connecting the current-carrying elements, which is insulated therefrom by a metal oxide layer during normal operation. When the filament is broken, the resulting potential between the connecting wire and the elements is sufficient to bridge the insulation layer, thereby restoring current to the remaining bulbs in a series-connected grid.

Other known switching devices are designed to cut the flow of current to the inner light-generating member of a high intensity discharge (HID) lamp, after the outer bulb is broken, in order to avoid danger from the intense ultraviolet (UV) rays emitted from the inner member. In such HID lamps, the UV emissions are normally either filtered out or converted to visible light by the intact outer member. Thus, U.S. Pat. No. 4,032,816 discloses a HID lamp having a spring-loaded safety switch, in which the spring bears against the outer bulb to hold the switch in a normally-closed position, thereby allowing current to flow to the inner light-generating member. When the outer bulb is broken, the spring-loaded switch is opened, cutting current to the inner member. U.S. Pat. No. 4,752,718 discloses a similar spring-loaded safety switch for a HID bulb.

None of the prior devices work to prevent current from escaping from a damaged lamp element into the immediate surroundings, particularly in a situation where escape of such current could instantly cause severe or even fatal injury to people in the immediate vicinity of the failed bulb.

Of particular concern are swimming pool lights in which an incandescent bulb is enclosed within a sealed envelope having a glass wall through which light is directed into the pool water. The light fixture is permanently embedded in a side wall of a swimming pool. If the glass envelope is broken, the bulb itself will shatter due to the in-rushing cold water striking the hot glass. It is clear that the possibility of electrical shock exists from consequent contact of the current and the water, making it imperative that the current be diverted or shut off immediately. Even though the current supplied to such lights may be less than 15 volts, a significant danger of electrical shock exists when such a fixture is broken. In the art, this has been accomplished by a variety of circuit breakers, ground-fault current-interrupters, and spring-loaded devices mounted external to the bulb or lamp. An example is a grounding connection which is pre-loaded to swing in to the area vacated by the shattered envelope, the current connection being thereby diverted or grounded.

SUMMARY OF THE INVENTION

This invention provides an electric incandescent light bulb with a grounding device built into the envelope of the bulb, and in close proximity to the current-carrying elements of the bulb, for use primarily in a submerged swimming pool light fixture, and overcomes certain limitations of the prior art.

According to the present invention, the grounding device is located within the incandescent bulb, closely adjacent the filament supports and the filament of the bulb. The grounding apparatus becomes operative when the filament is broken or becomes dismounted or otherwise separated as a result of rupture of the submerged glass lens of the light fixture. In the present invention, the filament supports are spring biased and held in a normal bulb-operative position by the filament, and are released for movement in accordance with the spring bias when the filament is broken. The movement in accordance with the spring bias brings the exposed, conductive, current-carrying portion of the filament supports into direct electrical contact with the grounding device, thereby directing the current to ground.

Rupture of the lens in a submerged light fixture results in a cascade of reactions. When the lens is ruptured, pool water rushes into the fixture and quickly causes the hot incandescent bulb to shatter. This results in breakage of the filament and contact of the pool water with the electrical current supplying the bulb. The current may pass through a person in the pool or in contact with pool water and an electrical ground. The present invention provides an immediate ground for the lamp current, actuated by breakage of the filament.

The present invention prevents the possibility of an electric shock to persons in or near the swimming pool at the time the lens is ruptured, by providing a route of escape to ground for current which may otherwise cause electrical shock to humans, or to cause damage to other adjacent electrical devices. The present invention further allows use of a means for detecting the current diverted to ground, thereby allowing a signal to be sent to cut current and initiate repair.

The present invention provides an incandescent light bulb having the grounding means built into the bulb, so that the grounding means is replaced each time the bulb is replaced. This replaceability prevents factors such as corrosion or other time- or environment-related effects as a source of possible malfunction of the grounding device.

DETAILED DESCRIPTION OF THE INVENTION

Figure 1:
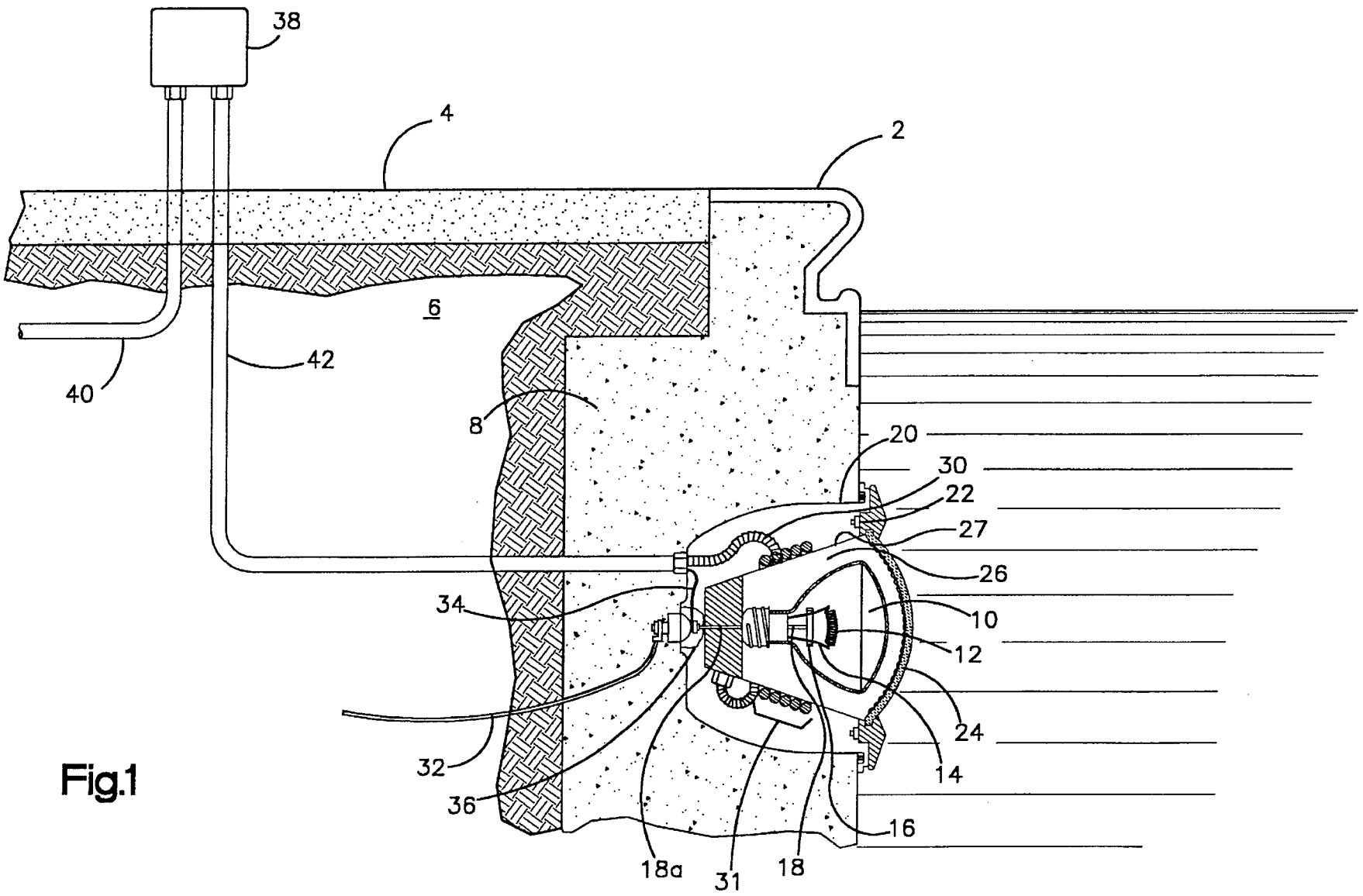
FIG. 1 is a sectional view of a lamp in accordance with the present invention, disposed in the wall of a swimming pool.
Figure 2:
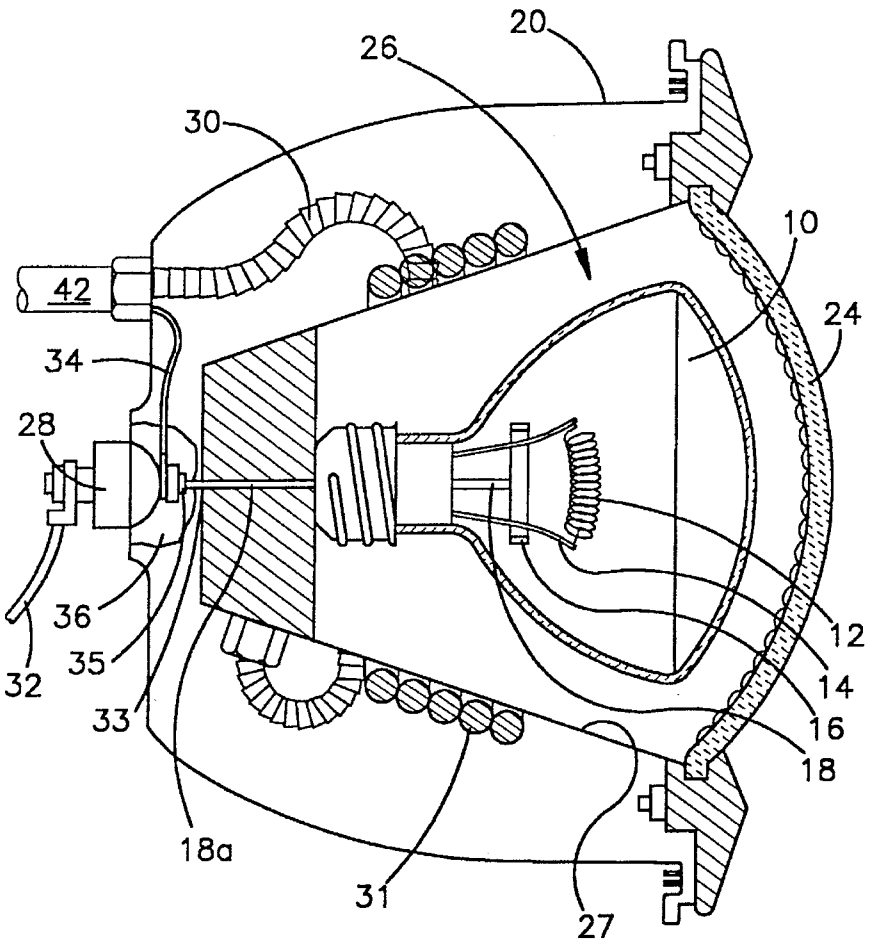
FIG. 2 is a sectional view of a lamp in accordance with the present invention, similar to that shown in FIG. 1.

Referring now to the figures, and particularly to FIGS. 1 and 2, there is illustrated an incandescent lamp 10 according to this invention. The lamp 10 is installed in a wet-niche fixture 26 mounted within a below-water-level housing or forming shell 20. The shell 20 is mounted in a side 2 of a swimming pool, and is normally at least 18 inches below the normal water level. The wet-niche fixture 26 is designed to be completely surrounded by and submerged in water, including space between the shell 20 and the fixture 26, thus the designation wet-niche.

The forming shell 20 is permanently mounted in a concrete wall 8 of the pool. The shell 20 is connected to a current supply conduit 42 and to an inside/outside grounding/bonding terminal 28. The shell 20 is sealed around each of these connections to prevent entry of pool water into surrounding earth 6 or the conduit 42.

The conduit 42 supplies current to the fixture 26 via a multiconductor grounded cord 30. The cord 30 is flexible, and long enough to allow the fixture 26 to be removed from the shell 20 and lifted out of the water to the pool side 2 for servicing. The excess wire 30 is preferably wrapped in a coil 31 around the fixture 26.

According to the invention, the bulb or lamp 10 includes a means for immediately grounding the current supply upon breakage of the filament 12. The filament 12 is suspended between two or more filament support arms 14. The means provided by the invention for grounding the current supplied to the filament 12 causes an exposed current-conductive portion of at least one of the filament support arms 14 to come in contact with a grounding device 16 upon breakage of the filament 12. The preferred means for achieving the grounding is to provide a spring bias to the arms 14 which is restrained by the filament. The spring bias may be outwardly or inwardly directed. The terms outwardly and inwardly primarily connote the filament support arms 14 moving away from or toward each other, respectively, in response to the spring bias. Thus, breakage of the filament 12 causes the filament support arms 14 to be free, allowing them to move from a first, restrained position, to a second position in contact with the grounding device 16.

Figure 5:
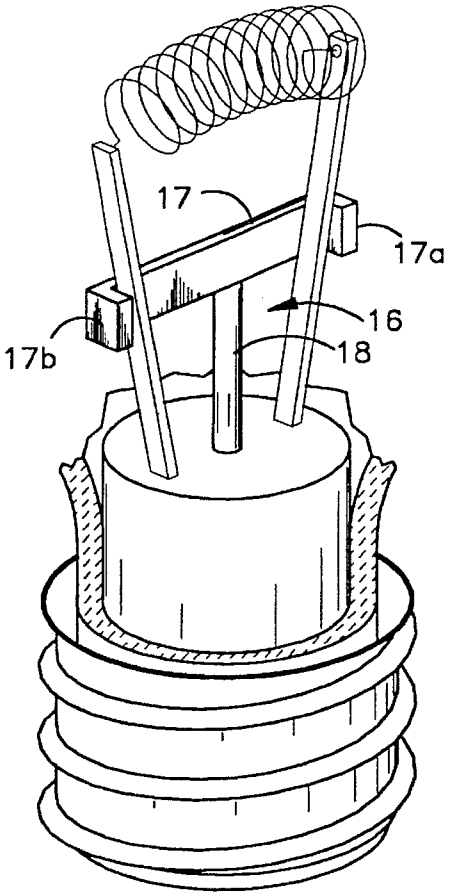
FIG. 5 is a perspective view of a lamp in accordance with the present invention, similar to those of FIGS. 1 and 2, in the area of the filament and grounding device.
Figure 4:
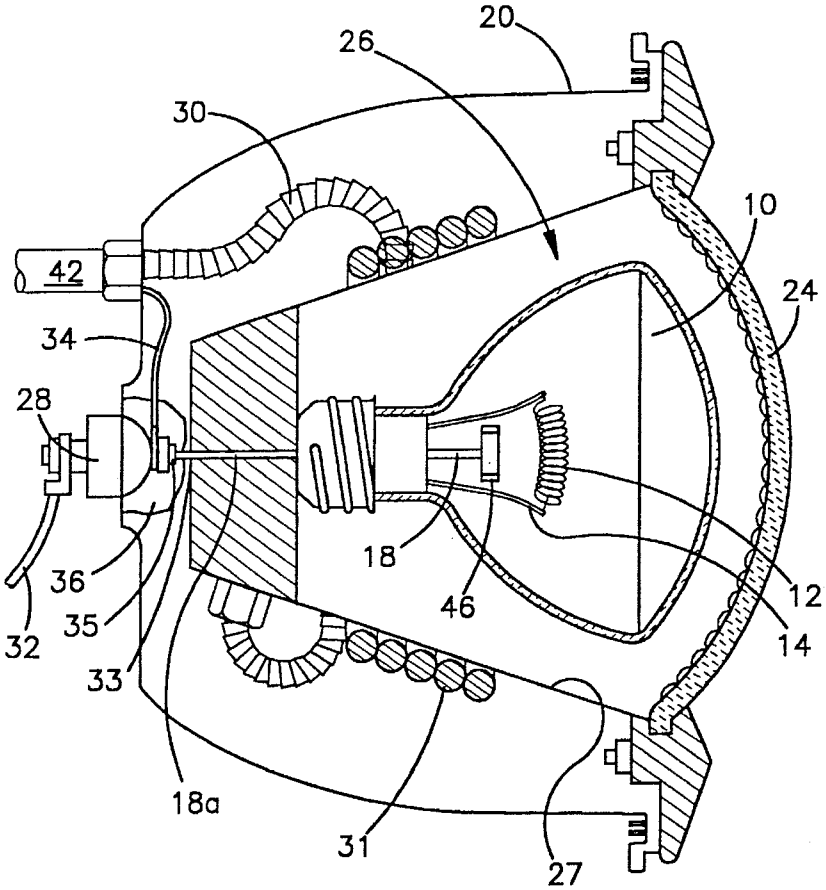
FIG. 4 is a sectional view of another embodiment of the lamp in accordance with the present invention.

As best shown in FIG. 5, the grounding device 16 is T-shaped and has a central elongated grounding shaft portion 18 oriented approximately parallel to the orientation of a pair of filament support arms 14. The ground shaft portion 18 passes through the lamp base. The grounding device 16 further includes a cross-arm portion 17 which is oriented perpendicular to the orientation of the arms 14, and includes end extensions 17*a* and 17*b*. The extensions 17*a* and 17*b* provide the contact surface for the current carrying filament support arms 14 when the lamp experiences a failure of the filament 12. It will be observed that the extensions 17*a* and 17*b* may be a continuous band encircling or otherwise completely surrounding the filament support arms 14.

It will be further observed that other configurations, such as a Y-shaped grounding device, are likewise possible equivalents for the preferred T-shape for the grounding device 16. In such a Y-shaped device the grounding shaft 18 would be split into arms which would be angled upward as well as outward, and could again have extensions analogous to the extensions 17*a* and 17*b* above, or such extensions could constitute a continuous band surrounding the filament support arms 14.

Figure 6:
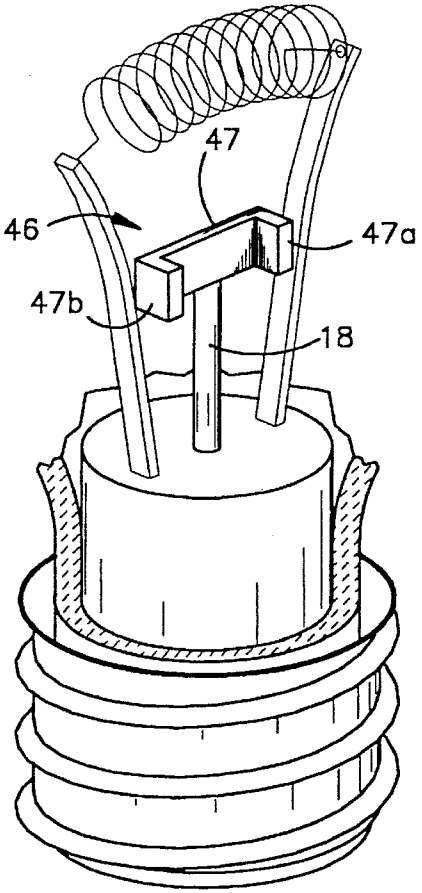
FIG. 6 is a perspective view of another embodiment of the lamp in accordance with the present invention, similar to that shown in FIG. 4, in the area of the filament and grounding device.

As best shown in FIG. 6, the grounding device 46 is T-shaped and has a central elongated grounding shaft portion 18 oriented approximately parallel to the orientation of a pair of filament support arms 14*a*. The grounding device 46 further includes a cross arm portion 47 which is oriented perpendicular to the orientation of the filament arms 14*a*, and includes end extensions 47*a* and 47*b*. The extensions 47*a* and 47*b* provide the contact surface for the current carrying filament support arms 14*a* when the lamp experiences a failure of the filament 12*a*. It will be observed that the extensions 47*a* and 47*b* may be a continuous band forming a small diameter circle or other completely enclosed shape disposed between the filament support arms 14.

Both pairs of filament support arms 14 and 14*a* are spring-biased to move from a first, normal, restrained position to a second grounding position when the filament 12, 12*a* is broken. Thus, in the disclosed embodiments of the invention, the filament 12, 12*a* restrains the arms 14 or 14*a* in the first position, and when the filament 12, 12*a* is broken, the arms 14 or 14*a* move to a second position in which they encounter the grounding device 16 or 46 and thereby provide a ground for the current which would otherwise be conducted through surrounding things.

The filament support arms 14 and 14*a* may be made of any material known in the art, consistent with the intended purpose of the present invention. The preferred material is a flexible, highly conductive metal having good spring characteristics. Each support arm 14, 14*a* intended to contact the grounding device 16, 46 should have a flexible portion which allows sufficient movement of the arm when the restraining filament 12, 12*a* is broken for the filament 12, 12*a* to contact the grounding device 16, 46. The support arm 14, 14*a* further includes an exposed current-conducting portion in a proper position to come into electrical contact with the grounding device 16, 46 when the restraining filament 12, 12*a* is broken.

The grounding device may be mounted either outboard of the filament support arms 14, or between the arms 14*a*, depending on the direction of the spring bias. In the preferred embodiment of the invention, the grounding device 16 is mounted outboard the support arms 14, the filament 12 is mounted in tension between the support arms 14, and the filament 12 acts to restrain the arms 14 from moving outwardly, effectively holding them closer together than they would be in the absence of the filament 12. Breaking the filament 12 allows the support arms 14 to spring outwardly away from each other and into contact with the grounding device 16. The connection thus formed provides a direct connection between incoming current and ground, thereby diverting the current intended to be supplied to the lamp 10 away from the pool water and to ground.

In an alternative embodiment, a grounding device 46 is mounted between the filament support arms 14*a*, the filament 12*a* is mounted in compression between the support arms 14*a*, and the filament 12*a* acts to keep the spring-like filament support arms 14*a* from coming together in response to the spring bias. Breaking the filament 12*a* allows the arms 14*a* to spring inward towards each other and into contact with the grounding device 46. The connection formed provides a direct connection between incoming current and ground, thereby diverting the current intended to be supplied to the lamp 10 away from the pool water.

In both embodiments, the filament 12, 12*a* acts to restrain the spring-like support arms 14, 14*a* from moving toward the grounding device 16, 46, as the support arms 14, 14*a* are urged by the spring-characteristics of each support arm 14, 14*a*. In each embodiment, breaking the filament 12, 12*a* results in freeing the arms 14, 14*a*, thereby allowing the arms 14, 14*a* to move in their spring-biased direction and to come into contact with the grounding device 16 or 46.

The grounding device 16, 46 is disposed at, or near, a first end of the grounding shaft 18 near the filament 12, 12*a*. The grounding shaft 18 extends through the base of the lamp 10 and provides a protruding pin end 18*a* which is received within an adjacent, collinear grounding tube 18*b*. The grounding tube 18*b* extends through the base 29 of the fixture 26, and terminates in an exposed conducting surface 33. As best shown in FIG. 2, when the fixture 26 is mounted in the forming shell 20 for operation, the conducting surface 33 of the fixture 26 contacts an exposed conducting surface 35 on the pool side of the inside/outside grounding/bonding terminal 28.

When the fixture 26 is removed from its mounted position in the forming shell 20, the conducting surface 33 of grounding shaft 18*b* loses contact with the conducting surface 35 of the grounding terminal 28. Although the grounding connection just described is broken when the fixture 26 is removed from the shell 20, the lamp 10 and the fixture 26 remain grounded at all times through a panel-box-connected ground wire 15 carried in cord 30. Thus, when the fixture 26 is installed in the shell 20 and the grounding surface 33 is in contact with the grounding surface 35, a second direct grounding connection is provided in addition to that provided by the panel-box-connected ground wire 15 in the cord 30.

The inside/outside grounding/bonding terminal 28 is sealingly mounted through a rear of the forming shell 20. The terminal 28 is sealed by a seal 36 formed from a sealing compound, such as an epoxy- or silicon-based material. The seal 36 should be adequate to prevent pool water from passing through the grounding opening in the pool wall 8 and into the earth 6. A similar seal is provided on the connection between the shell 20 and the conduit 42, to avoid entry of pool water into the conduit 42 or the earth 6.

The terminal 28 is electrically connected to a grounding wire 32. According to the requirements of the National Electrical Code®, the grounding wire 32 has a diameter at least as large as no. 8 solid copper bonding conductor. The grounding wire 32 is in turn is connected to a common bonding grid (not shown) underlying the entire pool structure.

In addition to the ground wire 32, and the grounding tube 18*b*, one end of a grounding cable 34 is attached to terminal 28. The grounding cable 34 connects through the power supply conduit 42 to the ground bar (not shown) in the junction box 38 mounted above the deck 4 and away from the side 2 of the pool. The junction box 38 contains either a transformer for reducing supply current from 120 volts to 12 volts, or a ground fault current interruption device, if current is supplied to the lamp 10 at 120 volts. The junction box ground bar is connected in turn to a ground bar in a panel box.

In most other aspects, the lamp 10 is similar to a conventional incandescent bulb, preferably operating on either 12 or 120 volts and rated at 300 watts. Of course, other voltages and wattages may be used.

The fixture 26 is releasably sealed for operation and forms a watertight compartment having a dry internal environment. The fixture 26 includes a glass lens 24, releasably sealed to the front of the fixture 26 by various known means generally comprising fastening devices and sealing devices such as gaskets or O-rings. The entire sealed fixture 26 is releasably mounted to the shell 20 by bolts or other attachment means, with the glass lens 24 oriented towards the pool. Clearly, the part of fixture 26 most vulnerable to accidental damage is the glass lens 24, which is exposed to the pool environment. If the glass lens 24 is cracked, broken or shattered, water leaking into the fixture 26 may cause the lamp 10 to shatter, and the filament 12 to be broken. The electrical current would then be free to seek an electrical ground through the pool water, if the means of the present invention were not provided.

It should be understood that breaking the filament 12, 12*a* of the lamp 10 includes simple breakage, dismounting such as when one end of the filament 12, 12*a* becomes loose, "burning out," i.e., destruction of the filament 12, 12*a*, and any other form of malfunction which could allow release of current to the environment outside the bulb. Of particular interest herein, as previously described, is the catastrophic failure of the glass envelope of the lamp 10, and concomitant breaking of the filament 12, 12*a*.

Figure 3:
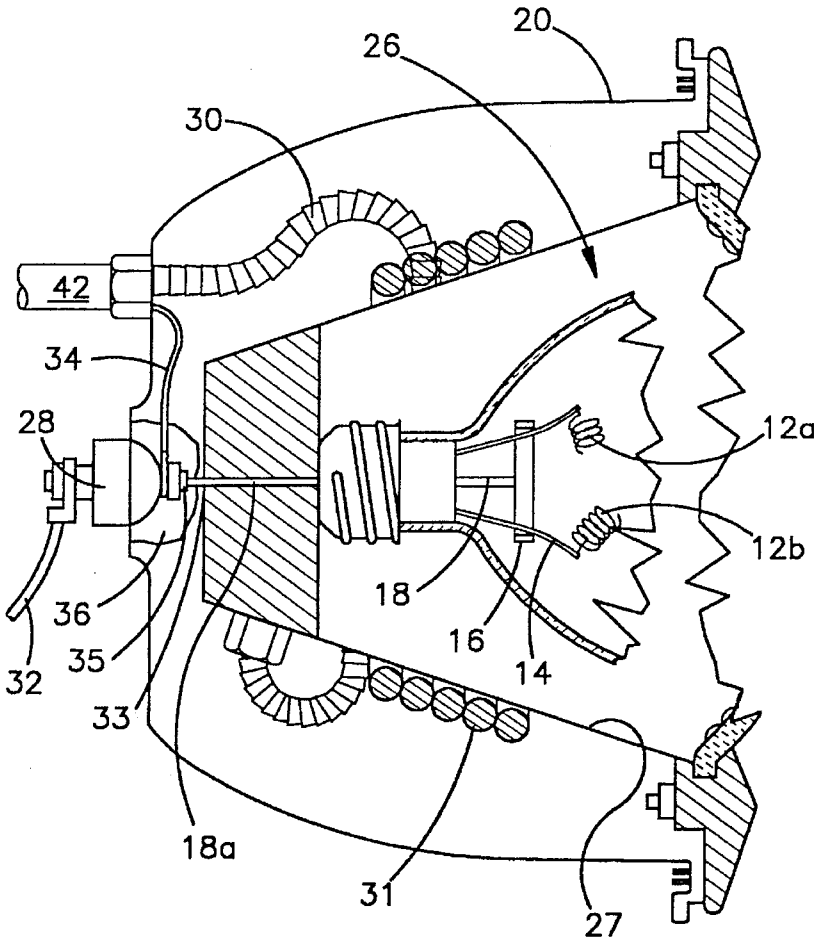
FIG. 3 is a sectional view of a lamp in accordance with the present invention, similar to those of FIGS. 1 and 2, following destruction of the filament.

The preferred embodiment is schematically shown in FIG. 3, after the lamp 10 and the filament 12 have been broken. When the lamp 10 is installed in the fixture 26, the grounding pin 18*a* is received within grounding tube 18*b*. The fixture grounding tube 18*b* is in contact with the exposed conducting surface 33 of the grounding terminal 28, which is in turn attached to the ground wire 32. Breakage of the filament 12, releases the filament support arms 14 which move outward to contact the grounding device 16. Thus the grounding device 16 provides an immediate direct-to-ground connection for diversion of the filament 12 current to the grounding device 16 and away from the in-rushing swimming pool water.

Because the grounding device 16, 46 is an integral part of the lamp 10, being sealed within the lamp 10 with the filament 12, 12*a*, the safety mechanism is fully protected from the environment, and a new grounding mechanism is installed each time the bulb 10 is replaced. This is a distinct advantage over prior art swimming pool current diversion or grounding devices, which tend to be a permanent part of the fixture 26 or the housing 20. Permanent installation of these prior devices in locations constantly wet and exposed to corrosive agents such as water, chlorine and various salts, has frequently resulted in failure of the prior art devices due to corrosion.

While the invention has been described for use in wet-niche fixtures for swimming pool lights, it is equally useful and novel in dry-niche fixtures. Dry-niche fixtures are intended to remain dry, and are provided with a drain to remove water collecting as a result of leaks or condensation. The dry-niche fixture, like the wet-niche fixture described above, is vulnerable to breakage of its water-interfacing glass lens, and subsequent exposure of pool water to the lamp current.

Although a self-grounding lamp according to this invention has been illustrated and described in detail, it will be understood that the invention is not limited correspondingly in scope, but includes all changes and modifications coming within the terms of the claims.

What is claimed is:

1. A bulb for use in a submerged swimming pool light fixture comprising a filament, at least one spring-biased filament support, and a grounding device connectable to a separate ground, wherein said filament support includes a current-conducting portion and is spring-biased for movement whereby said current conducting portion contacts said grounding device for diversion of an electrical current to the separate ground, and said filament is disposed to prevent said movement when said filament is intact, and to allow said movement when said filament is broken.

2. A submerged swimming pool light fixture comprising a grounding terminal having means for connecting said fixture to a separate electrical ground, said fixture being releasably sealed to form a watertight compartment, said fixture being adapted to receive an incandescent lamp, said lamp having a filament mounted on at least two filament support arms, at least one of said arms being spring-biased to move from a first position to a second position, said at least one of said arms being retained in said first position by said filament and moveable to a second position when said filament is broken, and a grounding device connected to said grounding terminal, said grounding device disposed to be in contact with said at least one of said arms when in said second position.

3. A fixture according to claim 2, wherein said filament support arm comprises two arms, and both of said arms are spring-biased.

4. A fixture according to claim 2, wherein said at least one arm is spring-biased to move radially outward toward said grounding device when said arm is released.

5. A fixture according to claim 2, wherein said at least one arm is spring-biased to move radially inward toward said grounding device when said arm is released.

6. An incandescent lamp mounted in a fixture in a swimming pool wall, comprising two filament support arms, at least one said arm being spring-biased for movement from a first position to a second position, a filament extending between said arms, said at least one said arm being maintained in said first position by said filament, said at least one said arm moving to said second position when said filament is broken, and a grounding device in contact with a separate electrical ground, wherein in said second position said at least one said arm is in electrical contact with said grounding device.

7. A lamp according to claim 6, wherein said at least one said arm is spring-biased to move radially outward, and said filament is mounted in tension between said arms.

8. A lamp according to claim 6, wherein said at least one said arm is spring-biased to move radially inward, and said filament is mounted in compression between said arms.

9. An incandescent lamp mounted in a submerged fixture in a swimming pool wall, said lamp having at least two filament support arms, a filament suspended between said arms, said arms providing current to said filament, the improvement comprising a grounding device disposed within said lamp and connected to a separate ground, at least one of said arms being spring-biased for movement from a first operating position to a second grounding position in which said at least one arm is in grounding contact with said grounding device, said filament holding said at least one of said arms in said first position, and said at least one of said arms moving to said second position when said filament is broken.

10. A bulb according to claim 1 wherein the filament is attached at an end of the filament support.

11. A bulb according to claim 1 wherein the grounding device is insulated from the filament support.

12. A bulb according to claim 1 wherein the grounding device is generally T-shaped having a shaft and a cross-arm, the cross-arm being disposed so as to be contacted by the filament support when the current conducting portion contacts said grounding device.

13. A bulb according to claim 12 wherein the cross-arm is provided with flanges disposed so as to be contacted by the filament support when the current conducting portion contacts said grounding device.

14. A bulb according to claim 1 wherein the grounding device is fixed adjacent the filament support.

15. A bulb according to claim 1 further comprising a second filament support, the spring-biased filament support being connectable to a hot circuit and the second filament support being connectable to a return circuit.

16. A bulb according to claim 1 wherein the filament support is electrically connected to the filament.

17. A bulb according to claim 3 wherein one filament support arm is connectable to a hot circuit and the other filament support arm is connectable to a return circuit.

18. A bulb according to claim 3 wherein the grounding device is generally T-shaped having a shaft and a cross-arm, the cross-arm being disposed so as to be contacted by the filament support arms when the current conducting portion contacts said grounding device.

19. A bulb according to claim 18 wherein the cross-arm is provided with flanges disposed so as to be contacted by the filament support arms when the current conducting portion contacts said grounding device.

* * * * *